US010245635B2

(12) United States Patent
Liu et al.

(10) Patent No.: US 10,245,635 B2
(45) Date of Patent: Apr. 2, 2019

(54) LOW-PRESSURE MOLD FOR IMPROVING PERFORMANCE OF SPOKES OF ALUMINUM WHEEL

(71) Applicant: CITIC Dicastal CO., LTD, Qinhuangdao (CN)

(72) Inventors: Guohua Liu, Qinhuangdao (CN); Xu Wang, Qinhuangdao (CN); Xueqiang Li, Qinhuangdao (CN); Dong Xing, Qinhuangdao (CN); Junmeng Li, Qinhuangdao (CN); Changhai Li, Qinhuangdao (CN); Zhihua Zhu, Qinhuangdao (CN); Yongning Wang, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 0 days.

(21) Appl. No.: 15/640,708

(22) Filed: Jul. 3, 2017

(65) Prior Publication Data

US 2018/0001373 A1 Jan. 4, 2018

(30) Foreign Application Priority Data

Jul. 3, 2016 (CN) ..... 2016 1 0509327

(51) Int. Cl.
*B22C 9/06* (2006.01)
*B22C 9/28* (2006.01)
*B22D 18/04* (2006.01)

(52) U.S. Cl.
CPC ..... *B22C 9/065* (2013.01); *B22C 9/28* (2013.01); *B22D 18/04* (2013.01)

(58) Field of Classification Search
CPC .. B22C 9/06; B22C 9/28; B22D 18/04; B22D 27/04
See application file for complete search history.

(56) References Cited

U.S. PATENT DOCUMENTS 5,647,426 A * 7/1997 Prieto ..... B22C 9/28 164/122.1
2017/0120322 A1* 5/2017 Zhu ..... B22C 9/065

FOREIGN PATENT DOCUMENTS

CN 203565824 U * 4/2014
CN 203875309 U * 10/2014

OTHER PUBLICATIONS

EPO machine translation of CN 203565824 U (Year: 2014).*
The Properties of Asbestos, http://www.propertiesofmatter.si.edu/asbestos.html (Year: 2009).*

* cited by examiner

*Primary Examiner* — Kevin E Yoon
(74) *Attorney, Agent, or Firm* — Maier & Maier, PLLC

(57) ABSTRACT

A low-pressure mold for improving performance of spokes of an aluminum wheel. The mold is characterized in that cooling air holes in a bottom mold are moved for 10 mm outwards; heat-insulation grooves are formed in positions, 5 mm from the cooling air holes, of a back cavity of the bottom mold, and are 8 mm from the surface of a cavity; and the width of each heat-insulation groove is set to 8 mm. A circumference arrangement range of the heat-insulation grooves needs to be larger than the widths of the spokes, and the number of the heat-insulation grooves is defined by the number of the spokes. Heat-preservation asbestos is arranged in each heat-insulation groove, thereby further strengthening heat-insulation and heat preservation functions. One air hole is added based on the prior art, thereby increasing the cooling area and improving the cooling intensity.

2 Claims, 2 Drawing Sheets

LOW-PRESSURE MOLD FOR IMPROVING PERFORMANCE OF SPOKES OF ALUMINUM WHEEL

TECHNICAL FIELD

The present invention relates to the field of low-pressure casting of aluminum wheels, and in particular to a low-pressure mold for improving performance of spokes of an aluminum wheel.

BACKGROUND ART

How to effectively eliminate hot spots of thick connection parts, namely spoke roots, of spokes and an outer bead seat is the recognized technical difficulty in the industry. As shapes of the spokes are special and different, and the modern wheels need light weight to lose the weight, the difficulty of removing the spoke root hot spots is further increased.

A wheel low-pressure air-cooling technique generally eliminates hot spots by the matching use of a top mold, a side mold, a bottom mold, and cooling air holes corresponding to the spoke root hot spots, wherein the mainly utilized cooling is side mold and bottom mold cooling. In the traditional design, if strengthening the cooling, it is easy to generate spoke root shrinkage defects to affect internal structure, performance and production stability. Therefore, how to reasonably design and maximize strengthening the cooling intensity to rapidly take away the heat of the spoke root hot spots without affecting sequence solidification of other parts and a temperature field of the mold becomes very important.

SUMMARY OF THE INVENTION

To overcome defects of the traditional design, the present invention provides a low-pressure mold for improving performance of spokes of an aluminum wheel. The mold can more effectively strengthen cooling of spoke roots, but not generate defects, and can further improve the casting production efficiency.

The low-pressure mold for improving the performance of the spokes of the aluminum wheel comprises a top mold, a bottom mold, cooling air holes, a side mold, heat-insulation grooves and heat-preservation asbestos.

The cooling air holes in the bottom mold are moved for 10 mm outwards, thereby reducing a cooling function to middle-part feeding channels of the spokes when strengthening the cooling, implementing sequence solidification from exterior to interior, and greatly strengthening the quick cooling of an outer rim and spoke root hot spots.

The heat-insulation grooves are formed in positions, 5 mm inwards along a radial direction from the cooling air holes, of a back cavity of the bottom mold, and are 8 mm from the surface of a cavity. The width of each heat-insulation groove is set to 8 mm. A circumference arrangement range of the heat-insulation grooves needs to be defined by different widths of the spokes. The width of each heat-insulation groove needs to be larger than the width of the corresponding spoke, so that the heat-insulation grooves can achieve a better heat-insulation function. Finally, the number of the heat-insulation grooves is defined by the number of the spokes.

The heat-preservation asbestos is arranged in each heat-insulation groove, thereby further strengthening heat-insulation and heat preservation functions.

One air hole is added based on the existing cooling air holes, thereby increasing the cooling ea and improving the cooling intensity. According to the width sum of the spokes, the cooling uniformity of the blowing rate is ensured. However, the number of the air holes in each spoke is at most four.

Compared with the traditional design, the low-pressure mold for improving the performance of the spokes of the aluminum wheel, provided by the present invention, has the advantages that: the manufacturing costs and the machining difficulty of the mold do not need to be increased. The field technicians feel simpler and purposeful to perform and control the casting technique. The present invention provides a more effective cooling mode for the cooling of the spoke root hot spots; during strengthening of the cooling, adverse effects to the middle-part feeding channels of the spokes and temperature fields can be avoided; a great amount of heat of the spoke root hot spots can be quickly taken away; the sequence solidification rate of the whole spokes is increased; the performance of the spokes is improved, and the internal structure of each spoke is refined.

In the figure, numeric symbols are as follows: 1—top mold, 2—bottom mold, 3—cooling air hole, 4—side mold, 5—heat-insulation groove, and 6—heat-preservation asbestos.

DETAILED DESCRIPTION OF THE INVENTION the following further describes the present invention in combination with figures.

Figure 1:
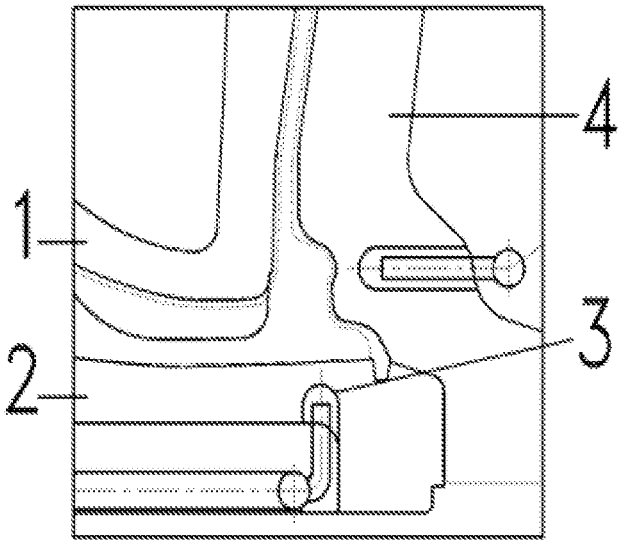
FIG. 1 (Prior art)
FIG. 1 is an assembly drawing of a mold in the prior art.
Figure 2:
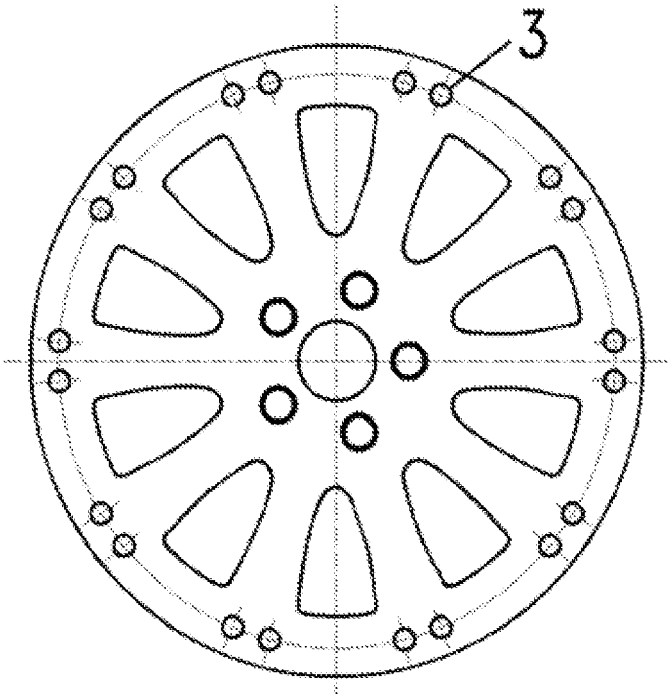
FIG.2 (Prior art)
FIG. 2 is a top view of a bottom mold in the prior art.
Figure 3:
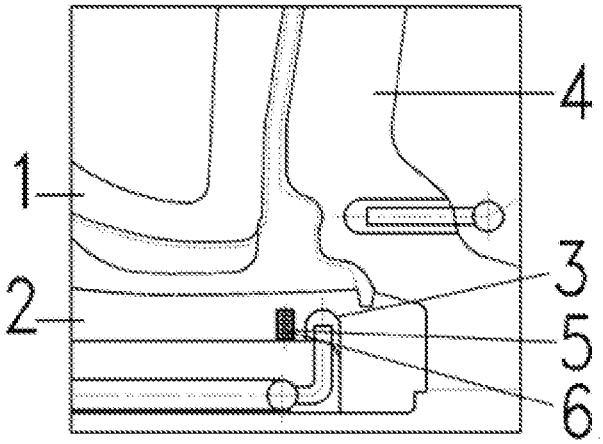
FIG. 3 is an assembly drawing of a mold provided by the present invention.
Figure 4:
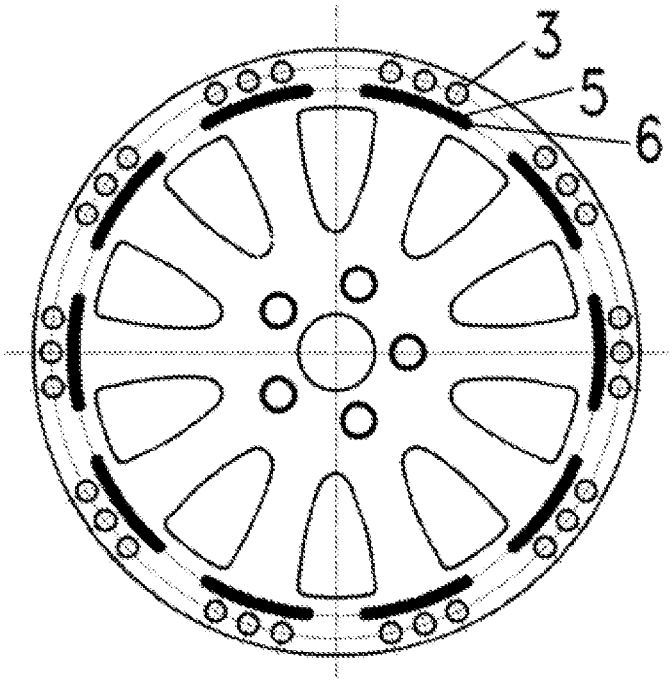
FIG. 4 is a top-view of a bottom mold provided by the present invention.

The FIG. 3 shows a low-pressure mold for improving performance of spokes of an aluminum wheel. The mold comprises a top mold 1, a bottom mold 2, cooling air holes 3, a side mold 4, heat-insulation grooves 5 and heat-preservation asbestos 6. The cooling air holes 3 in the bottom mold 2 are moved for 10 mm outwards, thereby reducing a cooling function to middle-part feeding channels of the spokes when strengthening the cooling, implementing sequence solidification from exterior to interior, and greatly strengthening the quick cooling of an outer rim and spoke root hot spots. The heat-insulation grooves 5 are formed in positions, 5 mm inwards along a radial direction of the bottom mold from the cooling air holes 3, of a back cavity of the bottom mold 2, and are 8 mm from the surface of a cavity. The width of each heat-insulation groove is set to 8 mm along the radial direction. In order to ensure the heat-insulation effect, the circumferential width of the heat-insulation grooves 5 needs to be larger than the widths of the corresponding spokes along the circumference of the bottom mold, and the number of the heat-insulation grooves 5 is defined by the number of the spokes. The heat-preservation asbestos 6 is arranged in each heat-insulation groove 5, thereby further strengthening heat-insulation and heat preservation functions. One air hole is added based on the existing two cooling air holes 3, thereby increasing the cooling area and improving the cooling intensity. However, the number of the air holes in each spoke is at most four.

By combining with the improvement of the mold structure, the occurrence of casting defects of the spokes is effectively avoided when the cooling is strengthened, the performance of the spokes is improved, the casting cycle is shortened, and the production efficiency is improved.

The invention claimed is:

1. A low-pressure mold for improving performance of spokes of an aluminum wheel, comprising:

a top mold, a bottom mold, cooling air holes, a side mold, heat-insulation grooves and heat-preservation asbestos;

wherein the cooling air holes in the bottom mold are arranged along a circumference of the bottom mold;

the heat-insulation grooves are formed in positions, 5 mm inwards along a radial direction of the bottom mold from the cooling air holes, of a back cavity of the bottom mold, and are 8 mm from the surface of a cavity;

and the width of each heat-insulation groove is set to 8 mm along the radial direction, and the circumferential width of each heat-insulation groove is larger than the circumferential width of the corresponding spoke along the circumference.

2. The low-pressure mold for improving the performance of the spokes of the aluminum wheel according to claim 1, wherein the heat-preservation asbestos arranged in the heat-insulation grooves; and the number of the air holes is more than two for each spoke, but the number of the air holes for each spoke is at most four.

* * * * *